United States Patent [19]

Gallet et al.

[11] Patent Number: 5,040,822

[45] **Date of Patent: * Aug. 20, 1991**

[54] SAFETY BINDING FOR AN ALPINE SKI

[75] Inventors: Yvon Gallet, Annecy Le Vieux; Gilles Renaud Goud, Annecy, both of France

[73] Assignee: Salomon S.A., Annecy Cedex, France

[ * ] Notice: The portion of the term of this patent subsequent to Mar. 27, 2007 has been disclaimed.

[21] Appl. No.: 307,990

[22] Filed: Feb. 9, 1989

[30] Foreign Application Priority Data

Feb. 11, 1988 [FR] France ..... 88 01948

[51] Int. Cl.[5] ..... A63C 9/085

[52] U.S. Cl. ..... 280/636; 280/625; 280/629

[58] Field of Search ..... 280/636, 634, 629, 625, 280/626

[56] References Cited

U.S. PATENT DOCUMENTS

| | | | |
|---|---|---|---|
| 3,353,835 | 11/1967 | Sommer | 280/612 |
| 3,544,123 | 12/1970 | Werner et al. | 280/636 |
| 3,785,668 | 1/1974 | Marker | 280/613 |
| 3,931,980 | 1/1976 | Marker | 280/611 |
| 4,600,213 | 7/1986 | Sedlmair et al. | 280/618 |
| 4,660,849 | 4/1987 | Sedlmair et al. | 280/625 |
| 4,804,202 | 2/1989 | Svoboda et al. | 280/636 |
| 4,911,464 | 3/1990 | Gallet et al. | 280/636 |

FOREIGN PATENT DOCUMENTS

| | | |
|---|---|---|
| 3005761 | 9/1980 | Fed. Rep. of Germany . |
| 3415272 | 10/1985 | Fed. Rep. of Germany . |
| 3624387 | 7/1987 | Fed. Rep. of Germany . |
| 2091429 | 1/1972 | France . |
| 2128012 | 10/1972 | France . |
| 431349 | 8/1967 | Switzerland . |

*Primary Examiner*—Andres Kashnikow
*Assistant Examiner*—Eric Culbreth
*Attorney, Agent, or Firm*—Sandler, Greenblum & Bernstein

[57] ABSTRACT

A binding assembly for releasably retaining an end of a boot on a ski. The binding assembly includes a binding having wings which, preferably, are independently movable, and a laterally movable support plate for at least the end of the boot. Preferably responsive to movement of the wings are abutments for limiting the lateral extend of movement of the plate. An engagement surface on the lower surface of the plate is mounted for cooperation with a corresponding surface adapted to be mounted fixed to the ski for facilitating lateral movement of the plate under load. These surfaces are preferably in the shape of a "W" and an inverted "W" in transverse cross-section, whose apices form an area of contact when the plate is aligned on the ski. No direct or indirect linkage is provided between the plate and the elements of the binding during release, however, and the plate is recentered after release in response to the return of the wings to their retention position.

39 Claims, 5 Drawing Sheets

SAFETY BINDING FOR AN ALPINE SKI

BACKGROUND OF THE INVENTION

1. Field of the Invention

The invention relates to a safety binding for an alpine ski which is adapted to retain the end of a boot, supported against the ski, and to release the end of the boot when it exerts an excessive force exceeding a predetermined threshold.

More precisely, the invention relates to a safety binding of this type, which is adapted to ensure the release of the boot at least in a lateral direction. Normally, such a binding is a front binding for retaining the front of the boot.

2. Description of Background and Relevant Information

It is known to equip front bindings with a support plate, on which rests the front of the boot. Generally, this support plate is equipped with means to limit the friction which is exerted principally between the boot and the ski or the boot and the jaw of the binding when the boot is laterally released.

Thus, it is known to mount a fixed support plate on the ski with a layer of anti-friction material on its upper portion, for example, a small plate of polytetrafluoroethylene. Such a construction is described in French Patent 2,128,012.

It is generally known to equip the front binding with a movable support plate, which is mechanically connected to the jaw of the binding, and which is displaced therewith. Such a construction is described, for example, in German Application DE-OS 3,005,761.

Another construction includes mounting a support plate at the rear of the binding which is movable independently of the elements of the binding. Abutments limit the lateral displacement of the support plate. Such a construction is described, for example, in Swiss Patent 431,349.

This construction is preferred because the support plate moves With the boot during a lateral release. Thus, the friction between the boot and the ski is transferred between the support plate and the ski. This friction thus does not depend on the state of the surface of the sole of the boot, which can be very variable depending upon the extent of wear.

Likewise, this construction is preferred because there is an independence between the movement of the support plate and the elements of the binding. Thus, if the support plate refuses to move laterally, for example, as a result of sticking due to ice, or a foreign body which impedes its movement, this does not disturb the operation of the binding contrary to the preceding case where this can prevent the binding from laterally opening.

Reference is also made to U.S. Pat. No. 4,911,464.

There is likewise known, according to German Application DE-OS 3,624,387, a movable support plate which is equipped with linkage means with the elements of the jaw. These linkage means ensure the return of the movable plate to the centered position after a lateral release.

It is more precisely these latter types of movable plates equipping a front binding to which the invention aims at providing improvements.

SUMMARY OF THE INVENTION

The present invention is directed to safety binding for an alpine ski adapted to retain the end of a boot supported by the upper surface of a ski through its sole, and to release the end of the boot when the boot exerts on the binding an excessive bias exceeding a predetermined threshold, and including:

(a) a body fixedly mounted on the ski;

(b) two wings for independent lateral retention of the boot journalled with respect to the body around respective substantially vertical axes and movable laterally against the force of an elastic return mechanism into a position by which they maintain the boot in substantially stable equilibrium in alignment with the vertical and longitudinal median plane of the ski;

(c) a support plate, or pedal, for the sole of the boot, which is positioned in the vicinity of the wings for lateral retention, the support plate being movable with respect to the upper surface of the ski, and guided in a manner so as to be freely laterally movable with respect to the ski, the plate being substantially symmetrical with respect to a vertical and longitudinal plane, and generally defining a substantially horizontal plane, substantially parallel to the upper surface of the ski, the support plate including a lower surface having at least two inclined ramps with respect to the support plate;

(d) two lateral abutments which limit the lateral movement of the movable support plate on both sides of its centered position in which its vertical plane of symmetry is substantially coincident with the longitudinal and vertical and median plane of the ski; and (e) a base for connection to the ski in an area proximate the ramps of the support plate at least along a transverse direction and a vertical direction, and which has on its upper surface at least two ramps which are inclined with respect to a plane defined by the upper surface of the ski;

wherein the inclined ramps of the plate have areas of contact with the ramps of the base, the areas of contact defining, when the movable plate is in its centered position, a contact plane, and wherein each of the ramps of the movable plate has a substantially symmetrical orientation with a respective one of the ramps of the base.

According to a further aspect of the invention, each lateral abutment which limits the lateral movement of the movable plate is connected to a wing in a manner so as to move from the longitudinal and vertical median plane of the ski when one of the wings moves towards the exterior of the ski and to approach the longitudinal and vertical median plane when the wing returns towards the interior, and that the abutments are positioned with respect to one another in a manner such that in the absence of the boot, the abutments limit the movement of the movable support plate to a substantially zero value, and maintain the movable support plate in the position where the ramps of the movable support plate are in contact with the ramps of the base in the contact plane.

According to a still further aspect of the invention, the movable plate has four ramps which are inclined with respect to the horizontal plane of the plate in a manner so as to generally form a "W", and that the base has four ramps which face one another and which generally forms an inverted "W". The apices of the ramps of at least one of the elements, i.e., the movable plate or base, which are in contact with the apices of the ramps of the other element, base or movable plate, when the movable plate is in its centered position, are truncated.

According to a still further aspect of the invention, the movable plate is pivotably mounted in rotation around a pivot which is substantially vertical and affixed to the ski and is positioned at the rear of the zone of ramps.

According to a still further aspect of the invention, the movable plate is slidably mounted along a transverse direction in a track which allows for its lateral movement and its vertical movement downwardly beginning at the stable equilibrium position.

According to a still further aspect of the invention, the base is constituted by the ski itself, and the ramps are located in the central area of the ski.

A further aspect of the invention is directed to the base which includes an element which is slidably mounted on the ski substantially along a horizontal and longitudinal direction, and the base is extended towards the front by a stay rod whose end is connected to the elastic return apparatus, and the ramps of the movable plate and the ramps of the base are inclined with respect to a horizontal plane defined by the plate and with respect to a horizontal and longitudinal direction, such that a downward bias of the boot on the movable plate causes a reduction of the lateral return force of the wings by the action of the stay rod of the base on the energy apparatus. The ramps can be inclined with respect to a horizontal and longitudinal direction from rear to front and top to bottom.

The present invention can be further defined as a binding assembly for releasably retaining an end of a boot on a ski including:

(a) a binding having wings for engaging the end of the boot, the wings being laterally movable relative to the longitudinal axis of the ski from a retention position to a release position;

(b) a laterally movable plate for supporting at least the end of the boot, the plate having a lower surface having at least two mutually inclined ramps; and (c) a base for connection to the ski, the base having at least two mutually inclined ramps for engagement with the ramps of the movable plate.

Further according to the invention, the plate is movable from an aligned position, in which the plate is substantially aligned with the vertical longitudinal median plane of the ski, to a laterally displaced position in which the plate is not substantially aligned with the vertical longitudinal median plane of the ski, wherein the base ramps are engagable with the plate ramps when the plate is in the laterally displaced position.

Still further according to the invention, the plate is movable from an aligned position, in which the plate is substantially aligned with the vertical longitudinal median plane of the ski, to a laterally displaced position in which the plate is not substantially aligned with the vertical longitudinal median plane of the ski, wherein two of the at least two mutually inclined ramps of the plate are connected by a truncated apex, wherein two of the at least two mutually inclined ramps of the base are connected by a truncated apex, and wherein, in the aligned position of the plate, the truncated apices of the plate and the base form a zone of contact. The zone of contact is a substantially horizontal plane when the binding is mounted upon a substantially horizontally oriented ski, and, in the substantially aligned position of the plate, each of the at least two plate ramps is positioned substantially symmetrically with a respective one of the base ramps.

Still further according to the invention, the plate ramps are inclined at least laterally with respect to the longitudinal axis of the ski.

In a further aspect of the invention, the plate ramps and the base ramps are further inclined longitudinally with respect to the ski. The invention can further include means for mounting the base for longitudinal movement relative to the ski and for biasing the base against longitudinal movement.

A still further aspect of the invention, the wings are functionally connected to the biasing means for maintaining the wings in the retention position. The wings are mounted for independent lateral movement.

In a still further aspect of the invention, an elastic return mechanism is provided functionally connected to the wings for biasing the wings in the retention position. The elastic return mechanism includes at least one spring, a portion of which is functionally connected to an element, the element being in functional engagement with the wings.

In a still further aspect of the invention the base is adapted for longitudinal movement relative to the ski, the binding assembly further including a member functionally connecting the element for biasing the base against longitudinal movement.

In this aspect of the invention, the binding assembly further includes a lateral abutment for limiting lateral movement of the plate on either side of the longitudinal axis of the ski. Each of the lateral abutments is mounted for movement with respective ones of the wings such that movement of one of the wings laterally away from the longitudinal axis of the ski results in movement of a respective abutment laterally away from the longitudinal axis of the ski for permitting movement of the plate laterally away from the longitudinal axis of the ski.

According to a still further aspect of the invention, the lateral abutments are configured and arranged relative to the remainder of the binding assembly to maintain the plate in a position substantially aligned with the longitudinal axis of the ski, wherein two of the at least two mutually inclined ramps of the plate are connected by an alignment contact portion, wherein two of the at least two mutually inclined ramps of the base are connected by an alignment contact portion, and wherein in the alignment position of the plate, the alignment contact portion of the plate ramps and the alignment contact portion of the base are positioned substantially opposite each other.

Still further according to the invention, four ramps are provided on the lower surface of the plate which generally form a "W" having two apices in transverse cross-section, and four ramps are provided on the base which generally form an inverted "W" having two apices in transverse cross-section, and the apices of the "W" are substantially opposite the apices of the inverted "W" in the alignment position of the plate.

According to a still further aspect of the invention, the plate is adapted to be mounted for pivotal movement about a substantially vertical axis about an end of the plate remote from the wings. The plate further includes a second end proximate the wings, whereby the plate is movable toward and away from the ski as the plate ramps engage the base ramps.

According to a still further aspect of the invention, the binding assembly further includes a transverse track within which the plate is mounted for lateral movement.

Still further according to the invention, the base ramps are associated with the track for permitting movement toward and away from the ski as the plate ramps engage the base ramps.

Still further the base can be integral with the ski, and the base ramps can also be integral with the ski.

The present invention can be further defined as a ski assembly for attachment to a ski, the assembly including:

(a) a plate for attachment to an upper surface of the ski and for being laterally movable relative thereto;

(b) a binding for attachment to the upper surface of the ski, the binding including independently movable first and second wings, and means for biasing the first and second wings into a stable boot retention position;

(c) means for limiting lateral movement of the plate to an amount determined by respective positions of the first and second wings; and (d) means for facilitating lateral movement of the plate.

According to an additional aspect of the invention the plate includes a lower surface, wherein the facilitating means includes at least one laterally inclined ramp formed in or connected to the lower surface of the ramp and a base formed in or connected to the ski, including at least one laterally inclined ramp, whereby the assembly is configured and arranged such that the at least one plate ramp is engagable with one of the at least one base ramp as the plate moves laterally such that downward pressure on the plate results in a force facilitating lateral movement of the plate.

Still further, the present invention can be defined as a binding assembly including:

(a) an anti-friction plate movable between a centered position and either of two opposite lateral positions;

(b) a binding including:

(i) a body;

(ii) a first wing movable relative to the body between a retention position and a release position; and (iii) a second wing movable relative to the body and movable relative to the first wing between a retention position and a release position;

(c) means responsive to the positions of the first wing and the second wing for limiting lateral movement of the plate; and (d) means for facilitating lateral movement of the anti-friction plate including at least one inclined surface on a lower surface of the anti-friction plate.

According to the invention, the facilitating means includes at least one inclined surface to be fixed mounted to the ski for engagement with the inclined surface of the anti-friction plate.

BRIEF DESCRIPTION OF THE DRAWINGS

The invention will be better understood with reference to the description below, as well as to the annexed drawings which are an integral part thereof.

DETAILED DESCRIPTION OF THE PREFERRED EMBODIMENTS

Figure 1:
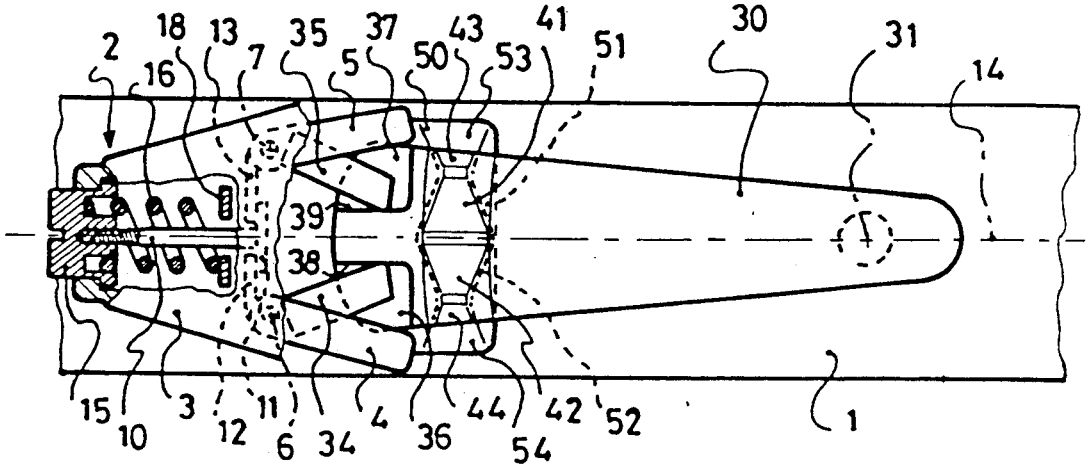
FIG. 1 schematically illustrates a top view of a binding in a non-limiting embodiment of the invention.

As discussed above, the present invention is particularly directed to binding assemblies having movable plates upon which at least an end of the boot is supported.

These types of movable plates are preferred because they are not very sensitive to the state of the surface of the sole of the boot. Furthermore, in the case of sticking or blocking, they do not prevent the binding from functioning normally.

However, it must be noted that although there may be almost no friction between the boot and the movable plate, friction does exist between the movable plate and the ski. This friction opposes the lateral release of the boot. Furthermore, the greater the boot exerts pressure against the ski, i.e., for example during a frontward fall, the greater this friction becomes.

One of the objects of the invention is to perfect these movable plates, by transforming the downward bias that the boot exerts on the ski into a motor effect, which compensates for the frictional forces caused between the movable plate and the ski, and which, as a result, facilitates the lateral movement of the boot and, as a result, its lateral release.

Another object of the invention is to propose a safety binding equipped with a movable plate in which the movable plate has no direct or indirect linkage with the elements of the front binding, during release, and in which the wings ensure the recentering of the movable plate after a release.

Other objects and advantages of the invention will become clear from the description which follows.

The safety binding according to the invention is adapted to retain the end of a boot, supported on a ski, and to release the end or the boot when it exerts an excessive bias on the binding exceeding a predetermined threshold.

It includes:

a fixed body mounted on the ski, two independent lateral retention wings journalled with respect to the body around a substantially vertical axis, and laterally movable against the action of an elastic return apparatus to a position where they maintain the boot in stable equilibrium substantially in alignment with the vertical and longitudinal median plane of the ski, a support plate for the sole of the boot, which is positioned in the vicinity of the lateral retention wings, which is movable with respect to the upper surface of the ski, and which is guided in a manner so as to have a free lateral movement with respect to the ski, the said plate being substantially symmetrical with respect to a vertical and longitudinal plane, and globally defining a substantially horizontal plane, substantially parallel to the upper surface of the ski, two lateral abutments which limit the lateral movement of the movable support plate, on both sides of its centered position in which its vertical plane of symmetry is merged with a longitudinal and vertical median plane of the ski.

It is characterized by the fact that the movable plate has at the level of its lower surface at least two ramps which are inclined with respect to the horizontal plane defined by the plate; that the ski has, in the zone of the ramps of the movable support plate, a base which is connected to the ski at least along a transverse and vertical direction, and which has on its upper surface at least two ramps which are inclined with respect to the plane defined by the upper surface of the ski; and that the inclined ramps of the plate are at least locally in contact with the ramps of the base, the zones of contact defining, when the movable support plate is in its centered position, a plane of contact; and that each of the ramps of the movable plate has a symmetrical orientation of a ramp of the base with respect to the plane of contact.

FIG. 1 illustrates a top view of a ski 1, at the position of the front binding 2. The ski is also equipped with a rear binding which is not shown and which can be of any appropriate type.

The front binding includes a body 3 which is mounted on the ski in a fixed manner or, if desired, by means of a known arrangement for adjusting the amount of shock absorption.

The front binding 2 furthermore includes two lateral retention wings 4 and 5 which are independent. These wings 4 and 5 are journalled in rotation around a substantially vertical axis, respectively 6 and 7.

Wings 4 and 5 are laterally movable against the action of an elastic return mechanism.

This elastic return apparatus is of any appropriate type and, for example, in FIG. 1, it is schematically shown a stay rod 10, oriented substantially longitudinally and includes a head 11. This head 11 is biased towards the rear by one or the other of fingers 12 or 13 which are respectively connected to wings 4 and 5, and which extend these wings beyond their respective journal axes 6 and 7 in the direction of the longitudinal and vertical median plane of the ski, which is schematically shown by axis 14 FIG. 1.

A cap 15 is connected to the other end of the stay rod 10, preferably by being screwed thereon.

The elastic return apparatus furthermore includes a compression spring 16, which is compressed between a fixed abutment 18 affixed to the body, and the movable cap 15, which follows the movement of the stay rod 10, in response to the bias of one or the other of the wings 4 and 5 towards the exterior.

Figure 14:
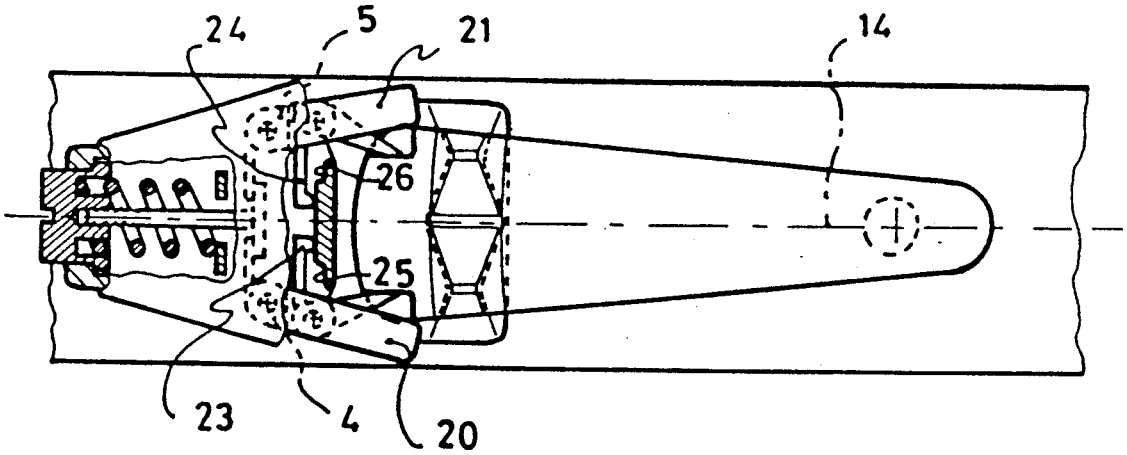
FIG. 14 illustrates an alternative embodiment at the level of the portion of the front binding which retains the boot.

The particular configuration of the elastic return apparatus just described is not limiting, however, and for example, as is shown in FIG. 14, wings 4 and 5 can be respectively extended, on the side of the boot, by extensions 20 and 21. It is these extensions which are in contact with the sole of the boot. Each of these extensions 20 and 21 is journalled to a wing 4 and 5 around a substantially vertical axis. Furthermore, each extension 20 and 21 has a finger 23 and 24 which is oriented towards the longitudinal axis and vertical median plane 14, and which extends towards a ramp 25 and 26 for opening of the extensions.

The operation of this front binding is similar in operation to the binding in FIG. 1. The difference is that, during a first phase of a lateral release, the extension biased by the boot, for example, the extension 20, moves from its equilibrium position with the wing 4 to which it is connected by journalling. Finger 23 follows the curve 25, and in a second phase when finger 23 reaches the opening zone of extension 20, this extension "breaks", i.e., moves with respect to wing 4, which causes the total opening of the extension towards the exterior, and the release of the boot.

The front binding furthermore includes a movable plate 30. This movable plate 30 is laterally movable with respect to ski 1. FIG. 1 illustrates a plate 30 which is movably rotatably mounted around a pivot 31 which is substantially vertical and affixed to the ski, and positioned at the rear of body 3 of binding 1.

The movable plate 30 extends towards the front substantially up to the zone of wings 4 and 5. It is adapted to serve as a support for the sole of the boot, at least in its front portion.

Preferably, the movable plate 30 is formed of a material which is vertically flexible which allows for a slight vertical movement of its front portion.

Furthermore, it is totally free to pivot laterally, without any return energy to overcome or without any linkage of the elements of the front binding such as the wings or the stay rod.

However, the free lateral movement of the movable plate 30 is limited by two abutments, one on each side of the longitudinal median axis 14 of the ski. These two abutments are shown at 34 and 35 in the figures. Each of these abutments 34 and 35 is movable and is connected rigidly to a wing, 4 and 5, respectively, which it follows in rotational movement. These abutments, in their rear portion, are engaged in two housings 36 and 37 of the movable plate 30, and they can respectively be supported against the surfaces 38 and 39 of the housings 36 and 37 which are oriented substantially parallel to the axis 14.

The relative arrangement of abutments 34, 35 and surfaces 38, 39 is such that, in the stable equilibrium position, i.e., in the absence of the boot, the movable plate 30 is maintained aligned on the longitudinal median axis 14 of the ski with a free movement which is reduced to a value which is substantially zero since the abutments 34 and 35 are substantially in contact with the surfaces 38 and 39. On the other hand, as soon as one wing moves from its equilibrium position, it displaces the abutment which is associated therewith, which increases the amount of free movement of the movable plate 30, principally on the side in which the wing is displaced.

In the embodiment of FIG. 14, the abutments 34 and 35 are fixedly connected to wings 4 and 5, as is the case in FIG. 1.

Figure 2:
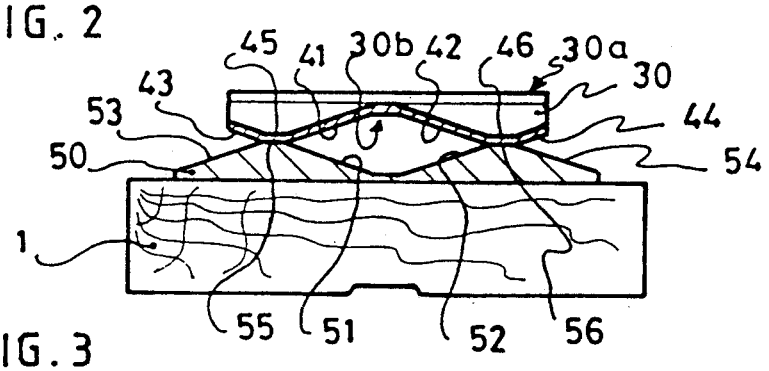
FIG. 2 is a transverse cross-sectional view of FIG. 1, at the level of the movable plate.

According to the invention, the movable plate 30 has, at its lower surface **30*b*, at least two ramps which are inclined with respect to the horizontal plane defined by the upper surface 30*a* of the movable plate. In FIG. 2, four ramps 41, 42, 43, 44, are shown at the lower surface 30*b* of the movable plate. These four ramps form a sort of "W", whose lower apices 45 and 46 are, preferably, truncated. Outside of the truncated apices 45, 46 the ramps 41–44** are substantially planar.

With regard to ramps 41–44 of the movable plate 30, ski 1 has a base 50 and the upper surface of this base 50 has at least two ramps which are substantially planar and which are positioned in opposition to the ramps of the movable plate.

FIG. 2 shows four ramps 51, 52, 53, 54, which are inclined with respect to the upper surface of the ski, and which form a sort of inverted "W", with respect to the "W" which the four ramps 41–44 of the movable plate 30 constitute. The apices 51 and 56 are preferably truncated as are apices 45 and 46. Outside of apices 55 and 56 the ramps 51–54 are substantially planar.

FIGS. 1 and 2 illustrate the movable plate 30 aligned in the vertical longitudinal median plane of the ski schematically shown by its line 14 in FIG. 1. In this position, the truncated apices 45 and 46 of the ramps of the movable plate 30 are in contact with the apices 55 and 56 of the ramps of base 50. These zones of contact define a plane of contact which, in the case of FIGS. 1 and 2, is substantially horizontal. The orientation of each of the ramps 43, 41, 42, 44 of the movable plate 30 is substantially symmetrical with a ramp 53, 51, 52, 54 of base 50, with respect to this substantially horizontal contact plane.

The operation of the front binding which has just been described is illustrated in the following figures.

Figure 3:
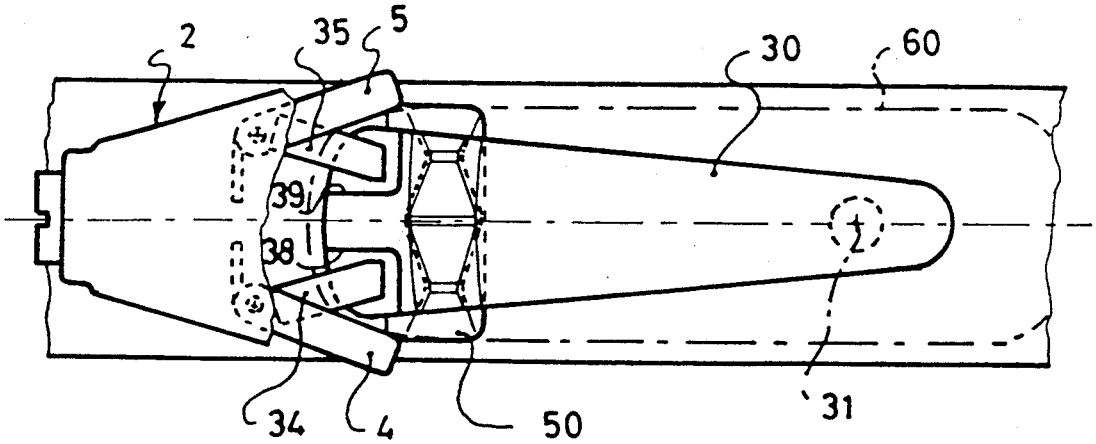
FIG. 3 is a view similar to FIG. 1, with the boot engaged in the front binding.
Figure 4:
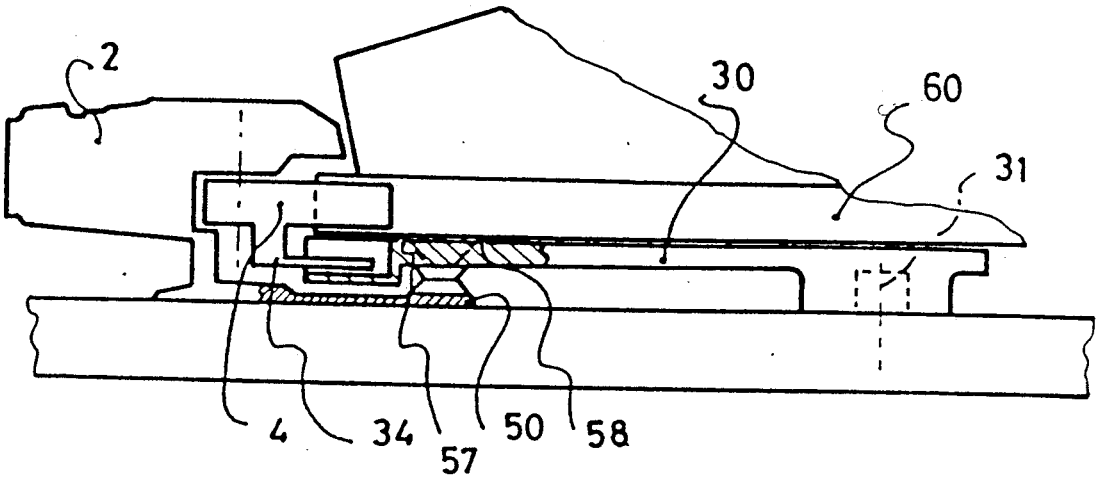
FIG. 4 is a side view of the apparatus shown in FIG. 3.

In FIG. 3, the relative position of the different elements of the front binding when the boot is present in the binding are schematically shown. The sole of the boot 60 is schematically shown in phantom lines. The engagement of the boot in the front binding causes a slight spacing of the wings, against the force of the elastic return apparatus. This slight spacing of the wings allows for an automatic adaptation of the front binding to the width of the sole of boot 60.

This has an effect that the abutments 34 and 35 space themselves from the surfaces 38 and 39 of the housings 36 and 37 of the movable plate 30, which gives to the movable 30 a freedom of displacement, over a small range of movement.

The movable plate 30 is thus maintained in a substantially centered position on the longitudinal median axis of ski 14 by the boot itself.

Likewise, the width of the truncated apices 45 and 46 of the movable plate 30 and that of apices 55 and 56 of base 50 is such that the movable plate 30 can move substantially from its alignment with axis 14, without causing, during a frontward fall, the compensation for the friction by cooperation of the inclined ramps which will be described below.

Figure 5:
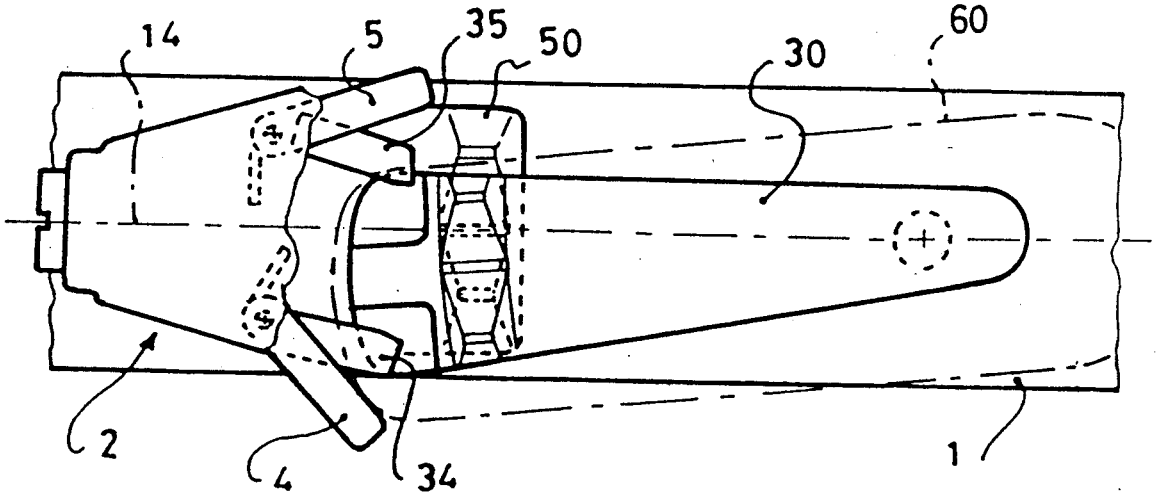
FIG. 5 is a top view which illustrates a lateral release of the binding.

FIG. 5 illustrates the front binding 2 subjected by boot 60 to forces which cause the opening of wing 4 so as to cause the release of the boot. The abutment 34 which is connected to wing 4 is likewise open, which gives to the movable plate 30 the possibility of being freely displaced in the direction of wing 4. In fact, it is boot 60 which moves with it the movable plate 30.

At the level of the ramps, there is a cooperation between a portion of at least one ramp of the movable plate 30 and a corresponding portion of at least one ramp of the base 50.

Figure 6:
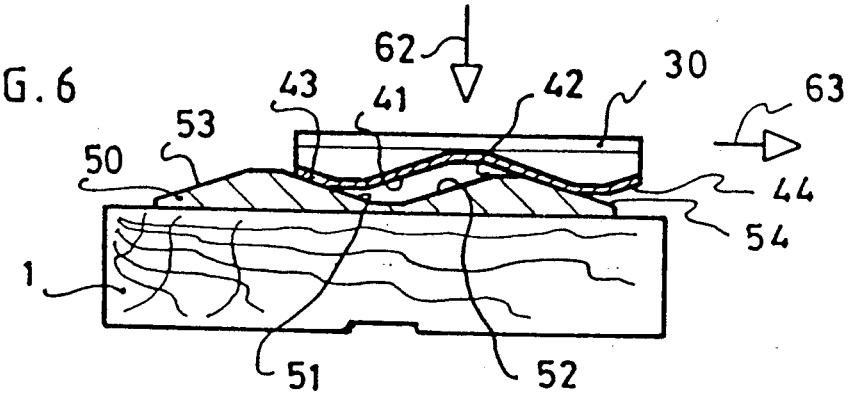
FIG. 6 is a transverse cross-sectional view of the apparatus of FIG. 5, at the level of the movable plate.

FIG. 6 illustrates ramps 43 and 42 of the movable plate 30 which come into contact with ramps 51 and 54 of base 50. At the level of these ramps, a downward bias of the boot on the movable plate 30, schematically shown by arrow 62, causes a reaction which itself has a component 63 which is oriented transversely in a horizontal plane. This component 63 has a motor role in the lateral displacement of movable plate 30, i.e., it favors this displacement, and thus compensates for the friction caused between the movable plate 30 and the base 50 by pressure of the boot on the ski.

Thus, during the lateral movement of the boot, the ramps of the movable plate 30 cooperate with the ramps of the base to diminish the friction which holds the movable plate 30 from its lateral displacement.

Furthermore, it must be emphasized that, during a release, the movable plate 30 is free to be displaced laterally without any direct action on wings 4 and 5 of the binding, or on the elastic return apparatus.

Figure 7:
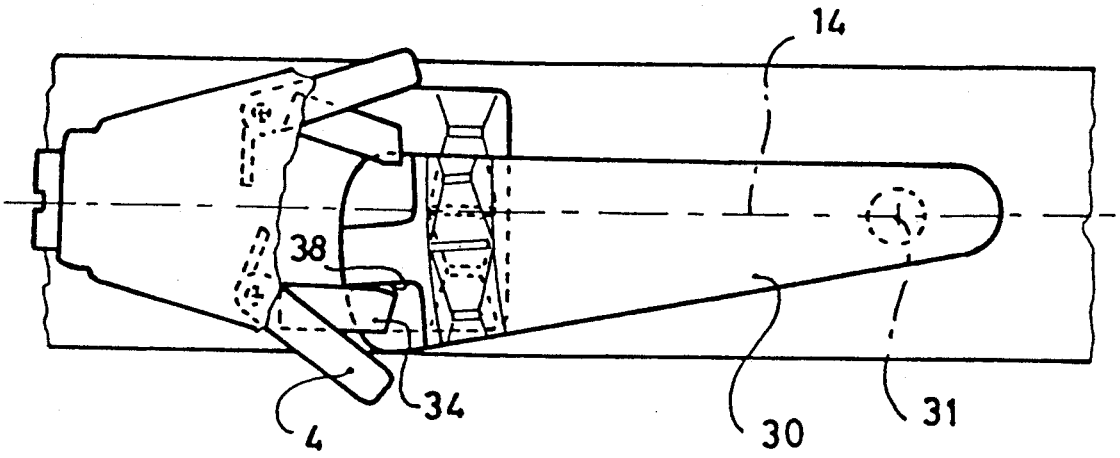
FIG. 7 illustrates the return of the movable plate and of the binding after a lateral release.

FIG. 7 illustrates the return of wing 4 to its initial position, after release of boot 60. This return of wing 4 likewise causes the return of abutment 34, which comes into contact with surface 38 of housing 36 of movable plate 30. Thus, movable plate 30 is returned towards its centered equilibrium position on axis 14, i.e., the position of FIG. 1. It must be emphasized that it is the lateral wing 4 itself through the action of the elastic return mechanism, which ensures the return of movable plate 30 to its centered position, and that the movable plate has no return energy of its own.

With respect to the ramps, the reverse movement from the preceding movement occurs, until the truncated apices 45 and 46 of the movable plate 30 come into contact with the truncated apices 55 and 56 of base 50.

Figure 8:
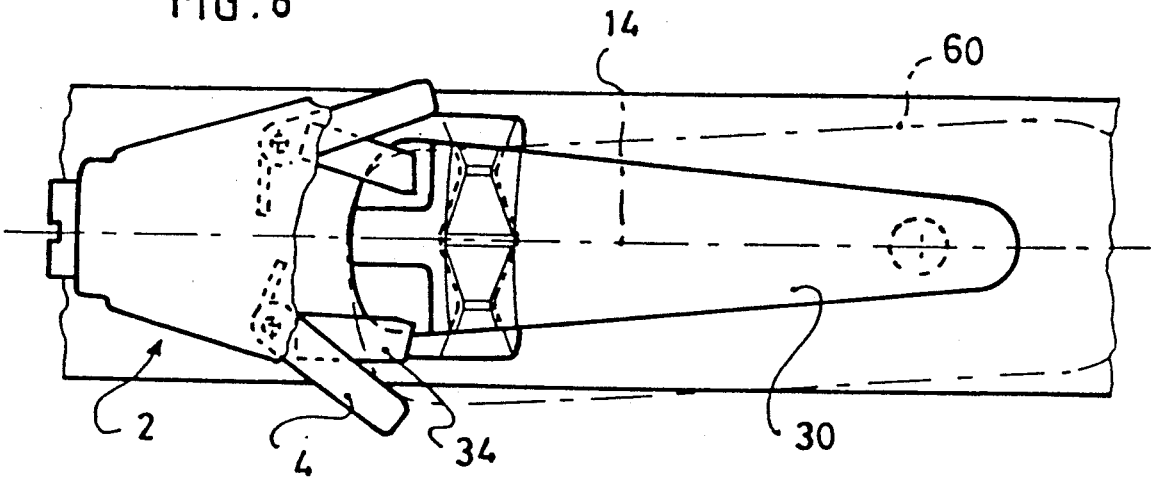
FIG. 8 illustrates the behavior of the binding, during a lateral release, with a blockage of the movable plate.

FIG. 8 illustrates the case where the lateral wing 4 is biased by the sole of the boot 60, but where the movable plate 30 is blocked, for example as a result of sticking to ice or a foreign body which interferes with its freedom of displacement.

As in the preceding case, wing 4 and abutment 34 move from axis 14, but the movable plate 30 remains aligned with this axis. Boot 60 thus slides directly on the upper surface of the movable plate 30, and it is at this level that friction occurs. If desired, these frictional forces can be reduced by the presence of a plate of polytetrafluoroethylene on the upper surface of the movable plate 30, in the manner described in the French patent cited in the Background of the Invention.

Other means can also be utilized to diminish the friction between the boot and the movable plate in this case. For example, the upper surface **30*a* of the movable plate 30 can have two transverse ribs in greater thickness 57 and 58 on which rests the sole of the boot. These ribs are thus situated in front and at the rear of the ramps 41–44**.

It should be noted that in the case of FIG. 8 that the release of the boot is not interfered with by operation of the movable plate 30.

The return of the wing to its centered position, after release of the boot, has no influence on movable plate 30, since it remains in its centered position.

Figure 9:
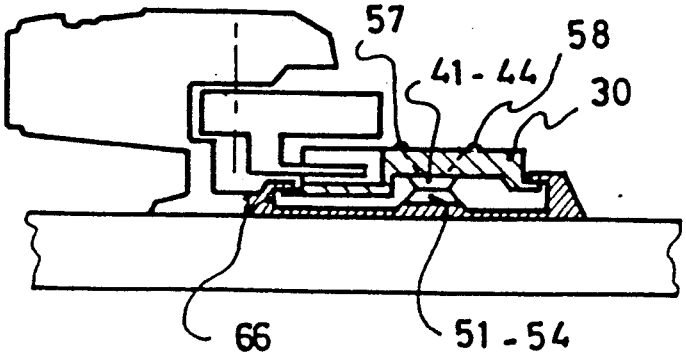
FIG. 9 illustrates a side view of an alternative embodiment of the movable plate shown in the preceding figures.

FIG. 9 illustrates an alternative embodiment, according to which movable plate 30, instead of being pivotably mounted around a pivot 31, is guided for a free lateral sliding in a track, oriented transversely, having a cross-sectional shape substantially in the form of a "C", open towards the top. This track 66 likewise carries, facing the ramps of movable plate 30, the ramps which were previously carried by the base.

Likewise, the track 66 allows for a slight vertical movement of the movable plate 30, in a manner so as to allow for the cooperation of the ramps.

Figure 10:
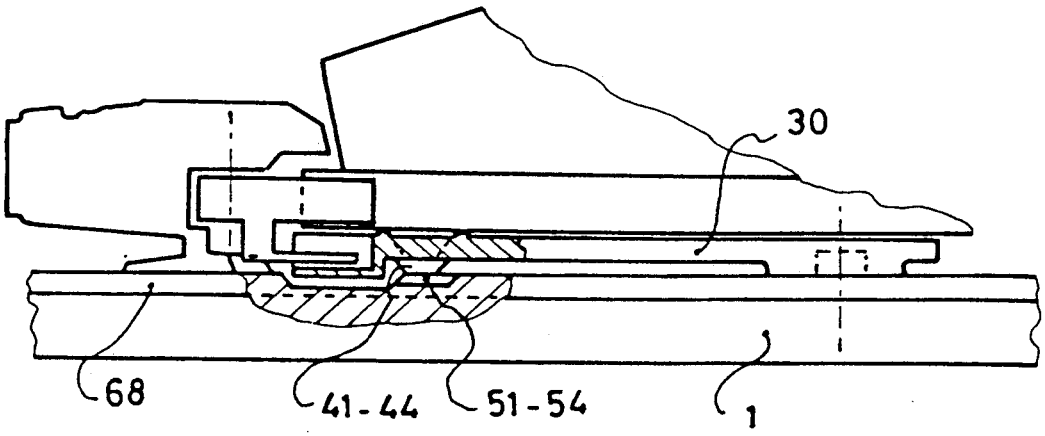
FIG. 10 illustrates another alternative embodiment of the front binding and of its movable plate, adapted to a ski of a particular shape.
Figure 11:
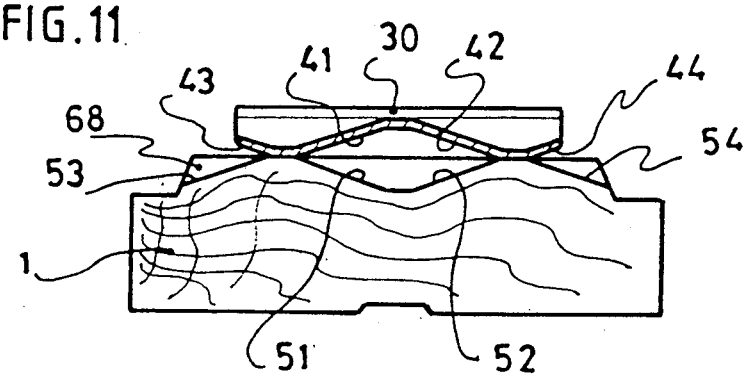
FIG. 11 is a transverse cross-sectional view of the apparatus of FIG. 10, at the level of the movable plate.

FIGS. 10 and 11 illustrate the case where the upper surface of the ski has in cross-section the form of an omega. This upper surface of the ski has, in its central zone, an edge 68, which is present over the entire length of the ski or, if desired, in the zone of the boot and of the bindings.

Ramps 51–54 are, in this case, directly formed in the edge 68, which constitutes the previously described base.

Movable plate 30, and its ramps 41–44 cooperate with ramps 51–54 of the ski, in the same manner as has been described relatively to the preceding figures.

Figure 12:
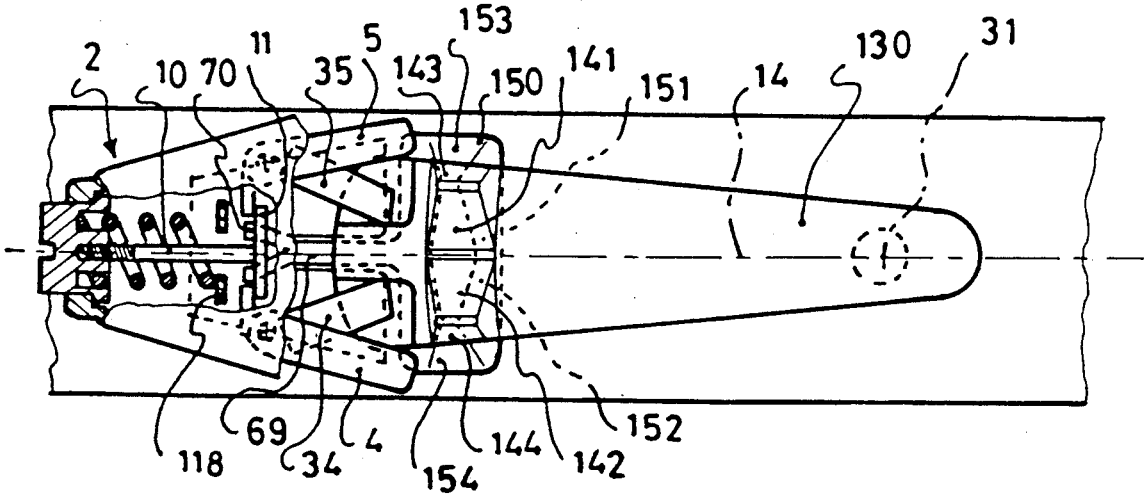
FIG. 12 illustrates an alternative embodiment of the apparatus of the preceding figures.
Figure 13:
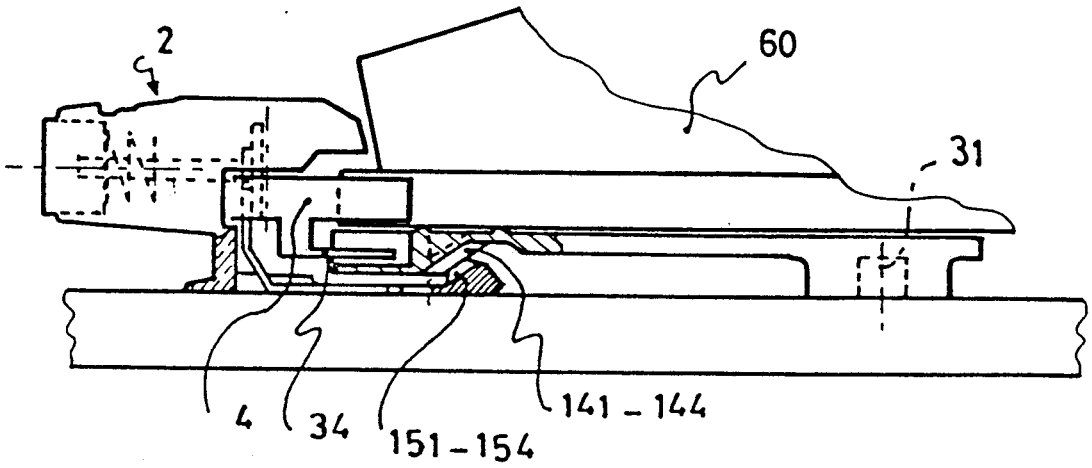
FIG. 13 is a side view of the apparatus of FIG. 12.

FIGS. 12 and 13 illustrate an alternative embodiment, according to which base 150 can be displaced longitudinally with respect to the upper surface of the ski. Furthermore, base 150 extends towards the body 2 of the front binding by a stay rod 69 which ends in a fork 70. This fork 70 receives the stay rod 10 of the elastic return apparatus immediately in front of head 11. As result, a longitudinal movement of movable base 150 towards the rear causes rearward movement of the stay rod 10, and thus an additional compression of the energy spring.

Ramps 141–144 of movable plate 130, as well as the ramps 151–154 of the base 150 are inclined as in the preceding case with respect to the horizontal plane defined by the upper surface of the movable plate 130, but furthermore they are inclined from the rear to the front and from top to bottom. Likewise, the previously defined contact plane is inclined from top to bottom and rear to front.

In this manner, the reaction force caused by a downward force of the boot on the ski has a horizontal component directed towards the rear of the ski, which causes base 150 to retract. This causes, in addition to what has been previously described, a direct action on the spring in the form of additional compression.

After a release, it is spring 16 itself which will bring back base 150 to the initial position. As to plate 130, it is the biased wing 4, 5, by means of its associated abutment 34, 35 which assures the return to the aligned position on axis 14.

Although the invention has been described with reference to particular means, materials and embodiments, it is to be understood that the invention is not limited to the particulars disclosed and extends to all equivalents within the scope of the claims.

What is claimed is:

1. A safety binding for an alpine ski adapted to retain the end of a boot supported by the upper surface of a ski through the sole of said boot, and to release the end of said boot when said boot exerts on the binding a bias exceeding a predetermined threshold, and comprising:

(a) a body fixedly mounted on said ski;

(b) a jaw for the lateral retention of said boot, carried by said body, including two lateral retention wings which are movable laterally against the force of an elastic return mechanism into a position by which said wings maintain the boot in substantially stable equilibrium in alignment with the vertical and longitudinal median plane of said ski;

(c) a support plate for said sole of said boot, which has a vertical plane of symmetry and which is positioned in the vicinity of said wings for lateral retention, said support plate being movable with respect to said upper surface of said ski, and guided in a manner so as to be freely laterally movable with respect to said ski, said plate being substantially symmetrical with respect to a vertical and longitudinal plane, and generally defining a substantially horizontal plane, substantially parallel to said upper surface of said ski, said support plate comprising a lower surface having at least two ramps which are inclined with respect to the upper surface of said ski;

(d) a lateral abutment connected to each of said two lateral retention wings which limit the lateral movement of said movable support plate on both sides of a centered position of said plate in which the vertical plane of symmetry of said support plate is substantially coincident with the vertical and longitudinal median plane of said ski; and (e) a base extending from said ski in an area proximate said ramps of said support plate at least along a transverse direction and a vertical direction, and which has on its upper surface at least two ramps which are inclined with respect to a plane defined by the upper surface of said ski;

wherein said inclined ramps of said plate have areas of contact with said ramps of said base, said areas of contact defining, when said movable plate is in its centered position, a contact plane, and wherein each of said ramps of said movable plate has a substantially symmetrical orientation with a respective one of said ramps of said base; and wherein said plate is movable from the longitudinal and vertical median plane of said ski when one of said wings moves towards the exterior of said ski and approaches the longitudinal and vertical plane when said wing returns the interior, wherein said abutments are positioned with respect to one another in a manner such that in the absence of said boot, said abutments limit the movement of said movable support plate to a substantially zero value, and maintain said movable support plate in a position wherein said ramps of said movable support plate are in contact with said ramps of said base in said contact plane.

2. A binding according to claim 1, wherein said movable plate has four ramps which are inclined with respect to said horizontal plane of said plate in a manner so as to generally form a "W", and that said base has four ramps which face one another and which generally forms an inverted "W".

3. A binding according to claim 2, the apices of said ramps of at least one of said elements, movable plate or base, which are in contact with said apices of said ramps of said other element, base or movable plate, when the movable plate is in its centered position, are truncated.

4. A binding according to claim 1, wherein said movable plate is pivotably mounted in rotation around a pivot axis which is substantially vertical and affixed to said ski and positioned at the rear of the zone of said ramps.

5. A binding according to claim 1, wherein said base is an element which is slidably mounted on said ski substantially along a horizontal and longitudinal direction, that said base is extended towards the front by a stay rod having an end which is connected to said elastic return apparatus, and that said ramps of said movable plate and said ramps of said base are inclined with respect to a horizontal plane defined by said plate and with respect to a horizontal and longitudinal direction, such that a downward bias of said boot on said plate causes a reduction of the lateral return force of said wings by the action of said stay rod of said base on said elastic return mechanism.

6. A binding according to claim 5, wherein said ramps are inclined with respect to a horizontal and longitudinal direction from rear to front and from top to bottom.

7. A binding according to claim 1, wherein said wings are mounted for independent lateral movement, each of said wings being journalled with respect to said body around a respective substantially vertical axis.

8. A safety binding for an alpine ski adapted to retain the end of a boot supported by the upper surface of a ski through the sole of said boot, and to release the end of said boot when said boot exerts on the binding a bias extending a predetermined threshold, and comprising:

(a) a body fixedly mounted on said ski;

(b) a jaw for the lateral retention of said boot, carried by said body, including two lateral retention wings which are movable laterally against the force of an elastic return mechanism into a position by which said wings maintain the boot in a substantially stable equilibrium in alignment with the vertical and longitudinal median plane of said ski;

(c) a support plate for said sole of said boot, which has a vertical plane of symmetry and which is positioned in the vicinity of said wings for lateral retention, said support plate being slidably mounted along a transverse direction in a track which allows for lateral movement of said support plate and, beginning at the stable equilibrium position with respect to said upper surface of said ski, downward movement of said support plate, said support plate being substantially symmetrical with respect to a vertical and longitudinal plane, said support plate having an upper surface which is substantially parallel to said upper surface of said ski, said support plate having a lower surface comprising at least two ramps which are inclined with respect to a plane defined by the upper surface of said ski;

(d) a lateral abutment connected for movement with a respective one of said two lateral retention wings which limit the lateral movement of said support plate on both sides of a centered position in which the vertical plane of symmetry of said support plate is substantially coincident with the vertical and longitudinal median plane of said ski; and (e) a base extending from said ski in an area proximate said ramps of said support plate at least along a transverse direction and a vertical direction, and which has on an upper surface of said base at least two ramps which are inclined with respect to the plane defined by the upper surface of said ski;

wherein said inclined ramps of said support plate have areas of contact with said ramps of said base, said areas of contact defining, when said support plate is in a centered position corresponding to said stable equilibrium position, a contact plane, and wherein each of said ramps of said support plate has a substantially symmetrical orientation with a respective one of said ramps of said base.

9. A safety binding for an alpine ski adapted to retain the end of a boot supported by the upper surface of a ski through the sole of said boot, and to release the end of said boot when said boot exerts on the binding a bias exceeding a predetermined threshold, and comprising:

(a) a body fixedly mounted on said ski;

(b) a jaw for the lateral retention of said boot, carried by said body, including two lateral retention wings which are movable laterally against the force of an elastic return mechanism into a position by which said wings maintain the boot in a substantially stable equilibrium in alignment with the vertical and longitudinal median plane of said ski;

(c) a support plate for said sole of said boot, which is positioned in the vicinity of said wings for lateral retention, said support plate being movable with respect to said upper surface of said ski, and guided in a manner so as to be freely laterally movable with respect to said ski, said support plate being substantially symmetrical with respect to a vertical and longitudinal plane, said support plate having an upper surface which is substantially parallel to said upper surface of said ski, said support plate comprising a lower surface having at least two ramps which are inclined with respect to the upper surface of said ski;

(d) a lateral abutment connected for movement with a respective one of each of said two lateral retention wings which limit the lateral movement of said support plate on both sides of its centered position in which the vertical plane of symmetry of said support plate is substantially coincident with the vertical and longitudinal median plane of said ski; and (e) a base unitarily formed with said ski in an area proximate said ramps of said support plate at least along a transverse direction and a vertical direction, said base having at least two ramps located in a central area of said ski, said ramps being inclined with respect to the plane defined by the upper surface of said ski;

wherein said inclined ramps of said support plate have areas of contact with said ramps of said base, said areas of contact defining, when said support plate is in a centered position corresponding to said stable equilibrium position, a contact plane, and wherein each of said ramps of said support plate has a substantially symmetrical orientation with a respective one of said ramps of said base.

10. A binding assembly for releasably retaining an end of a boot on a ski, said ski having a generally longitudinal axis, said safety binding assembly comprising:

(a) a binding having wings for engaging said end of said boot, said wings being laterally movable relative to said longitudinal axis of said ski from a retention position to a release position;

(b) a laterally movable plate for supporting at least said end of said boot, said plate having a lower surface having at least two inclined ramps;

(c) a base extending from an upper surface of said ski, said base having at least two inclined ramps for engagement with said ramps of said movable plate; and (d) a lateral abutment connected for movement with a respective one of each of said wings, and for relative movement with respect to said plate, for limiting lateral movement of said plate on either side of said longitudinal axis of said ski.

11. The binding assembly of claim 10 wherein said plate is movable from an aligned position, in which said plate is substantially aligned with the vertical longitudinal median plane of said ski, to a laterally displaced position in which said plate is not substantially aligned with the vertical longitudinal median plane of said ski, wherein said base ramps are engagable with said plate ramps when said plate is in said laterally displaced position.

12. The binding assembly of claim 11 wherein said at least two ramps of said lower surface of said plate comprises four ramps which generally form a "W" in transverse cross-section having two apices, wherein said at least two ramps of said base comprises four ramps which generally form an inverted "W" in transverse cross-section having two apices, wherein said apices of said "W" are substantially opposite said apices of said inverted "W" in said alignment position of said plate.

13. The binding assembly of claim 11 wherein said plate is adapted to be mounted for pivotal movement about a substantially vertical axis about an end of said plate remote from said wings.

14. The binding assembly of claim 13 wherein said plate comprises a second end proximate said wings, whereby said plate is movable toward and away from said ski as said plate ramps engage said base ramps.

15. The binding assembly of claim 11 further comprising a transverse track within which said plate is mounted for lateral movement.

16. The binding assembly of claim 15 wherein said base ramps are associated with said track for permitting movement toward and away from said ski as said plate ramps engage said base ramps.

17. The binding assembly of claim 10 wherein said plate is movable from an aligned position, in which said plate is substantially aligned with the vertical longitudinal median plane of said ski, to a laterally displaced position in which said plate is not substantially aligned with the vertical longitudinal median plane of said ski, wherein two of said at least two inclined ramps of said plate are connected by a truncated apex, wherein two of said at least two inclined ramps of said base are connected by a truncated apex, and wherein, in said aligned position of said plate, said truncated apices of said plate and said base form a zone of contact.

18. The binding assembly of claim 17 wherein said zone of contact is a substantially horizontal plane when said binding is mounted upon a substantially horizontally oriented ski, and wherein, in said substantially aligned position of said plate, each of said at least two plate ramps is positioned substantially symmetrically with a respective one of said base ramps.

19. The binding assembly of claim 10 wherein said plate ramps and said base ramps are inclined at least laterally with respect to said longitudinal axis of said ski.

20. The binding assembly of claim 19 wherein said plate ramps and said base ramps, further are inclined longitudinally with respect to said ski.

21. The binding assembly of claim 20 further comprising means for mounting said base for longitudinal movement relative to said ski.

22. The binding assembly of claim 21 further comprising means for biasing said base against movement.

23. The binding assembly of claim 22 wherein said wings are connected to said biasing means for maintaining said wings in said retention position.

24. The binding assembly of claim 10 wherein said wings are mounted for independent lateral movement.

25. The binding of claim 24 further comprising an elastic return mechanism operatively connected to said wings for biasing said wings in said retention position.

26. The binding assembly of claim 25 wherein said elastic return mechanism comprises at least one spring, a portion of which is operatively connected to an element, said element being in engagement with said wings.

27. The binding assembly of claim 26 wherein said base is adapted for longitudinal movement relative to said ski, said binding assembly further comprising a member functionally connecting said element for biasing said base against longitudinal movement.

28. The binding assembly of claim 10 further comprising one of said lateral abutments mounted for movement with respective ones of said wings such that movement of one of said wings laterally away from said longitudinal axis of said ski results in movement of a respective abutment laterally away from said longitudinal axis of said ski for permitting movement of said plate laterally away from said longitudinal axis of said ski.

29. The binding assembly of claim 10 wherein said lateral abutments are configured and arranged relative to the remainder of said binding assembly to maintain said plate in a position substantially aligned with said longitudinal axis of said ski, wherein two of said at least two inclined ramps of said plate are connected by an alignment contact portion, wherein two of said at least two inclined ramps of said base are connected by an alignment contact portion, and wherein in said alignment position of said plate, said alignment contact portion of said plate ramps and said alignment contact portion of said base are positioned substantially opposite each other.

30. The binding assembly of claim 10 wherein said base is integral with said ski, wherein said base ramps are also integral with said ski.

31. The binding assembly of claim 10 wherein each of said lateral abutments is positioned for engagement with a respective portion of said plate for limiting lateral movement of said plate.

32. A ski assembly for attachment to a ski, said assembly comprising:

(a) a plate for attachment to an upper surface of said ski and for being laterally movable relative thereto;

(b) a binding for attachment to said upper surface of said ski, said binding comprising first and second wings for engagement with a boot, and means for biasing said first and second wings into a stable boot retention position;

(c) means connected for movement with said wings for limiting lateral movement of said plate to an amount determined by respective positions of said first and second wings; and (d) means for facilitating lateral movement of said plate comprising means responsive to lateral movement of the boot with respect to either of said wings for facilitating lateral movement of said plate with respect to the ski.

33. The ski assembly of claim 32 wherein said plate comprises a lower surface, wherein said facilitating means comprises at least one laterally inclined ramp formed in or connected to said lower surface of said ramp and a base formed in or connected to said ski, including at least one laterally inclined ramp, whereby said assembly is configured and arranged such that said at least one plate ramp is engagable with one of said at least one base ramp as said plate moves laterally such that downward pressure on said plate results in a force facilitating lateral movement of said plate.

34. The ski assembly of claim 32 wherein said means for limiting lateral movement of said plate comprises abutments connected for movement with said wings and positioned for engagement with respective portions of said plate.

35. The ski assembly of claim 32 wherein said means for limiting lateral movement of said plate comprises abutments mounted for movement between positions adjacent respective portions said plate and laterally removed from said respective portions of said plate for permitting said plate, upon movement of said abutments to said laterally removed position, (i) to remain in said stable boot retention position and (ii) to move toward a laterally displaced position.

36. The ski assembly of claim 32 wherein each of said first and second wings is mounted for lateral movement independent of the other of said first and second wings.

37. The ski assembly of claim 32 wherein said means for facilitating lateral movement of said plate comprises means responsive to downward movement of the boot with respect to the ski for facilitating lateral movement of said plate with respect to the ski.

38. A binding assembly comprising:

(a) an anti-friction plate movable between a centered position and either of two opposite lateral positions;

(b) a binding comprising:

(i) a body;

(ii) a first wing movable relative to said body between a retention position and a release position; and (iii) a second wing movable relative to said body and movable relative to said first wing between a retention position and a release position;

(c) means affixed to said first wing and to said second wing which are responsive to the positions of said first wing and said second wing for limiting lateral movement of said plate; and (d) means for facilitating lateral movement of said anti-friction plate comprising at least one inclined surface on a lower surface of said anti-friction plate.

39. The binding assembly of claim 38 wherein said facilitating means further comprises at least one inclined surface to be fixedly mounted to said ski for engagement with said inclined surface of said anti-friction plate.

* * * * *